United States Patent [19]

David

[11] Patent Number: 4,633,603

[45] Date of Patent: Jan. 6, 1987

[54] SNOW REMOVAL APPARATUS

[76] Inventor: Pierre David, 1000, rue Riel, Laval, Quebec, Canada, H7C 2L6

[21] Appl. No.: 698,754

[22] Filed: Feb. 7, 1985

Related U.S. Application Data

[63] Continuation of Ser. No. 594,413, Mar. 28, 1984, abandoned, which is a continuation of Ser. No. 328,650, Dec. 8, 1981, abandoned.

[51] Int. Cl.[4] ..... E01H 5/00

[52] U.S. Cl. ..... 37/197; 37/196

[58] Field of Search ..... 37/197, 227; 15/300 R, 15/328, 336, 340, 409, 405, 415, 415 A, 418; 104/279; 246/428

[56] References Cited

U.S. PATENT DOCUMENTS

| | | | |
|---|---|---|---|
| 514,805 | 2/1894 | Astor | 15/405 |
| 2,180,269 | 11/1939 | Wisher | 15/405 X |
| 2,945,254 | 7/1960 | Boissonnault | 15/325 |
| 3,228,125 | 1/1966 | Wiebe | 37/197 |
| 3,972,497 | 8/1976 | Ringer | 246/428 |
| 4,018,483 | 4/1977 | Smith | 15/405 X |
| 4,070,771 | 1/1978 | Yakiwchuk | 15/405 X |
| 4,092,789 | 6/1978 | Arfons | 37/12 |
| 4,288,886 | 9/1981 | Siegler | 15/405 X |
| 4,360,949 | 11/1982 | Wilson | 104/279 |

FOREIGN PATENT DOCUMENTS

| | | | |
|---|---|---|---|
| 671186 | 9/1963 | Canada | 37/197 |
| 1088402 | 10/1967 | United Kingdom | 104/279 |
| 551423 | 5/1977 | U.S.S.R. | 37/197 |
| 616357 | 6/1978 | U.S.S.R. | 37/197 |

OTHER PUBLICATIONS

"Rem-Guns Save Time? Reduce Manpower" Railway Equipment & Methods Co, Railway Tracks & Structure 8/64 p. 16.

"A Blower & A Mower", Popular Science, Nov. 1978, p. 93 (Echo Blower).

*Primary Examiner*—Edgar S. Burr

*Attorney, Agent, or Firm*—Schwartz, Jeffery, Schwaab, Mack, Blumenthal & Evans

[57] ABSTRACT

A snow removal apparatus adapted to be mounted on a vehicle, for removing snow from a light fixture protruding from the ground. Structure is provided for creating a flowing stream of air and a nozzle connected to the air stream directs the air stream at the ground, the directed stream of air having a flow velocity of at least about 180 m.p.h. The nozzle is adapted to be operatively positioned adjacent the ground at an angle to deflect the directed air stream on the ground at a predetermined distance from the light fixture so as to cause the deflected air stream to impinge on the light fixture at a reduced velocity sufficient to remove snow therefrom without damaging same, and to spread over a surrounding area with sufficient pressure to clear the area of snow.

30 Claims, 7 Drawing Figures

SNOW REMOVAL APPARATUS

This application is a continuation of application Ser. No. 594,413, filed 3/28/84 and now abandoned, which is a continuation of Ser. No. 328,650 filed 12-8-81 now abandoned.

BACKGROUND OF THE INVENTION

The present invention is concerned with a snow removal apparatus for removing snow from a light fixture protruding from the ground, such as taxi-lights located on both sides of an airport runway. More particularly, the invention is directed to a snow removal apparatus of the type to be mounted on a vehicle.

Airport taxi-lights are to be distinguished from landing-lights in that they are less bulky and of more fragile construction and therefore are more susceptible to damage than are landing-lights during clearing of the runways in winter. Such taxi-lights generally have a diameter of about four inches and protrude above the ground to a height of about one foot; the base is made of white metal and thus can be easily broken by an inadvertent blow on the light. A series of these taxi-lights extend along each side of the runway.

In the clearing process of an airport runway, the runway itself is first cleared using conventional machines such as snow-ploughs and/or snow-blowers which move along the runway. The bulk of the snow adjacent one series of taxi-lights is next removed using such machines which move along a sinusoidal path so as to contour each light on one side thereof and the same sinusoidal path is followed on the other side. Thereafter, the remainder of the snow is manually removed from each light as well as from the immediate surrounding area so as to enable the light to viewed from a distance. This cleaning procedure is repeated from the other series of taxi-lights located on the other side of the runway. Since these lights are often completely covered with snow and hidden from the view as a result of a snow fall or of gusting winds piling up snow thereover, many lights do get damaged in the clearing process. Statistics show that as many as 600 taxi-lights or more per airport are destroyed every winter, at a cost of about $100 per unit, including labour for replacing the lights. This of course adds to the already high costs of labour for clearing the lights of snow.

Vehicles equiped to blow air against an airport runway to clear same have been proposed in U.S. Pat. No. 3,228,125 and in Canadian Pat. No. 671,186. These known runway cleaning machines use jet engines for discharging air at very high velocities so as to effectively and rapidly remove snow, slush, loose ice and water from the runway. Such air-blowing machines, however, cannot be used to remove snow from taxi-lights since the latter cannot withstand the pressure of the high velocity air produced and would thus break away. On the other hand, if the velocity of the air is reduced sufficiently to avoid breaking the lights, the pressure thereof is insufficient to clear a suitable area of snow around each light.

SUMMARY OF THE INVENTION

Accordingly, it is an object of the invention to overcome the above drawbacks and to provide a snow removal apparatus for effectively and rapidly removing snow from a light fixture without damaging same, and simultaneously clearing a surrounding area of snow.

In accordance with the present invention, there is thus provided a snow removal apparatus adapted to be mounted on a vehicle, for removing snow from a light fixture protruding from the ground, comprising means for providing a flowing stream of air and nozzle means connected to the air stream providing means for directing the air stream at the ground, the air stream providing means and nozzle means being adapted to produce a directed stream of air having a flow velocity of at least about 180 m.p.h. The nozzle means is adapted to be operatively positioned adjacent the ground at an angle to deflect the directed air stream on the ground at a predetermined distance from the light fixture so as to cause the deflected air stream to impinge on the light fixture at a reduced velocity sufficient to remove snow therefrom without damaging same, and to spread over a surrounding area with sufficient pressure to clear the area of snow.

It has surprisingly been found that by deflecting an air stream having a flow velocity of at least about 180 m.p.h. on the ground at an angle of deflection and at a distance from the light fixture such that the deflected air stream impinges on the light fixture and spreads over a surrounding area, snow can be effectively and rapidly removed from the light fixture without damaging same while the surrounding area may be simultaneously cleared of snow.

According to a preferred embodiment of the invention, the nozzle means comprises a housing having upper and lower converging walls and a head with an opening which are shaped to provide a shallow sweeping air stream exiting therefrom. A similarly shaped flap member is preferably disposed in the head transversely to the direction of flow and hinged to the upper wall for pivotal movement between open and partially closed positions, actuating means being provided for pivotally moving the flap member between these positions so as to adjustably vary the opening and thereby provide a directed air stream having a desired velocity and shallowness.

Preferably, the nozzle means is mounted forwardly of the vehicle and is swingable about a vertical axis along an arcuate path so as to be operatively oriented transversely to the direction of travel of the vehicle, in either lateral direction extending away from the vehicle.

In a particularly preferred embodiment, a guide means is mounted on the vehicle and is laterally spaced from the nozzle means with the light fixture therebetween for guiding the snow blown away from the light fixture and the surrounding area so as to prevent the blown snow from swirling above the light fixture and falling back thereonto. Such snow guide means may take the form of an elongated open-ended duct extending rearwardly of the nozzle means and being downwardly opened along its entire length, one end of the duct being adjacent the light fixture and defining a mouth opening for receiving the blown snow. The duct is adapted to dampen the air entraining the blown snow so as to cause the snow to pile up remotely of the light fixture.

BRIEF DESCRIPTION OF THE DRAWINGS

A preferred embodiment of the invention will now be described in greater detail with reference to an example thereof as illustrated in the accompanying drawings, wherein.

DESCRIPTION OF PREFERRED EMBODIMENTS

Figure 1:
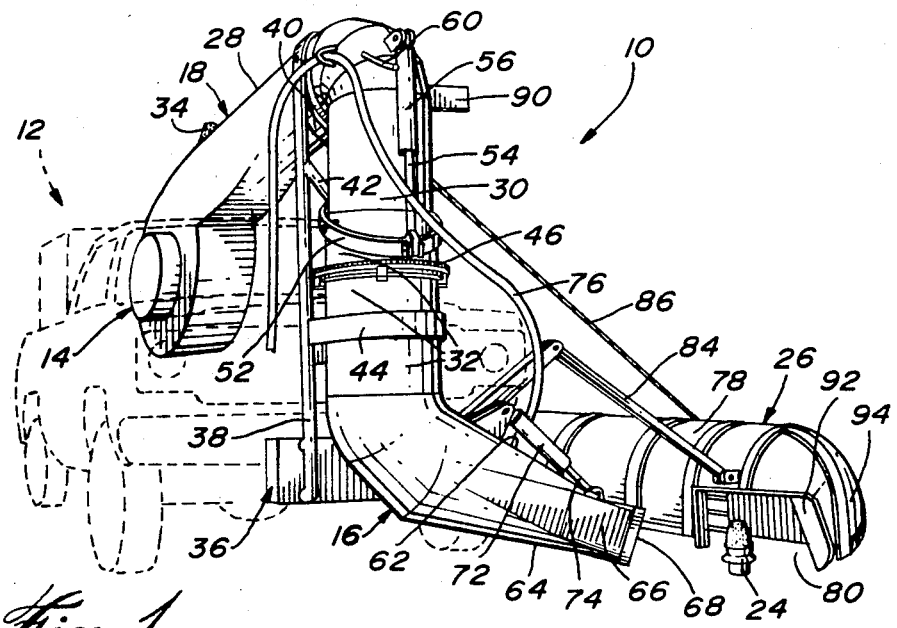
FIG. 1 is a perspective view of a snow removal apparatus according to the invention.

Referring to the drawings, and particularly to FIGS. 1–4 thereof, there is illustrated a snow removal apparatus generally designated by reference numeral 10 and mounted on a ¾ ton 4×4 truck 12 shown in broken line. The apparatus 10 comprises an air blower 14 in the loading compartment of the truck, a nozzle 16 at the front end of the truck and a duct 18 interconnecting the air blower 14 with the nozzle 16. The nozzle is positioned such that the directed air stream 20 exiting therefrom is deflected on the ground and the deflected air stream 22 impinges on the taxi-light 24 to thereby remove snow therefrom and spreads over a surrounding area to clear the same of snow. A snow guide 26 is provided for receiving the snow blown away from the light 24 and the surrounding area and for channelling it to the rear remotely of the light.

The air blower 14 includes a motor driven fan (not shown) capable of producing at the exit of nozzle 16 a directed air stream 20 flowing at a velocity of at least about 180 m.p.h., preferably of about 200 to about 250 m.p.h. The duct 18 has a horizontal section 28 extending over the cab and hood of the truck and a front vertical section comprising telescoping inner and outer duct portions 30 and 32. A flasher 34 is mounted on top of the blower 14 for signaling the presence of the thus equipped truck.

A supporting structure 36 is provided for securing the duct 18 which carries the nozzle 16 to the truck 12. The structure 36 includes a pair of vertical tubular frame members 38 which hold at their upper ends the duct section 28 by means of the collar 40. A pair of cross-bars 42 (only one shown in FIG. 1) interconnect the frame members 38 together to provide added rigidity. A sleeve 44 slidably retains the lower outer duct portion 32 so as to enable the duct portion 32 to be moved vertically as well as to be rotated about its vertical axis.

Figure 2:
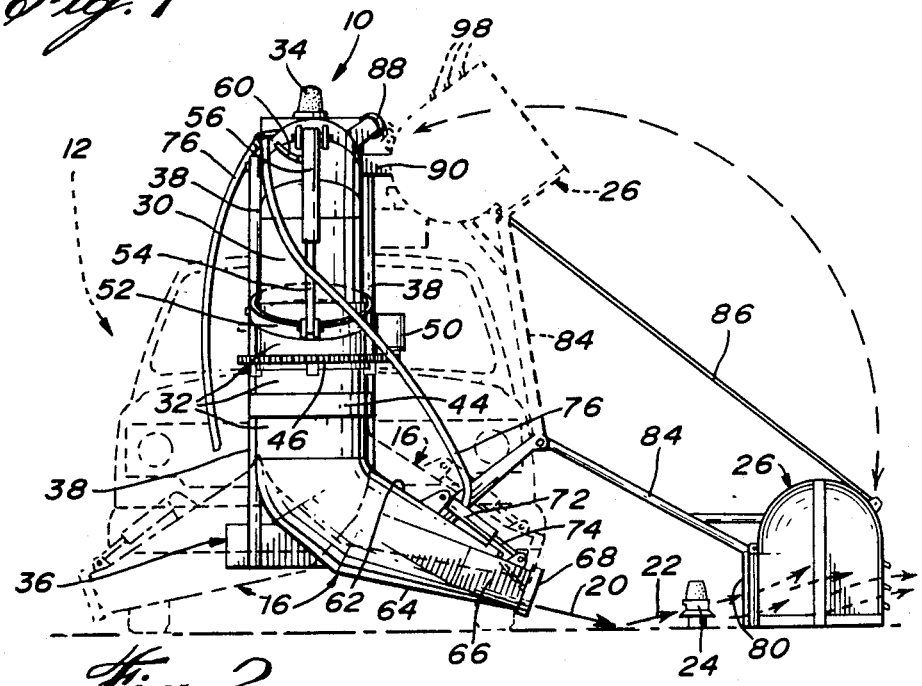
FIG. 2 is a front elevation view of the apparatus illustrated in FIG. 1.
Figure 3:
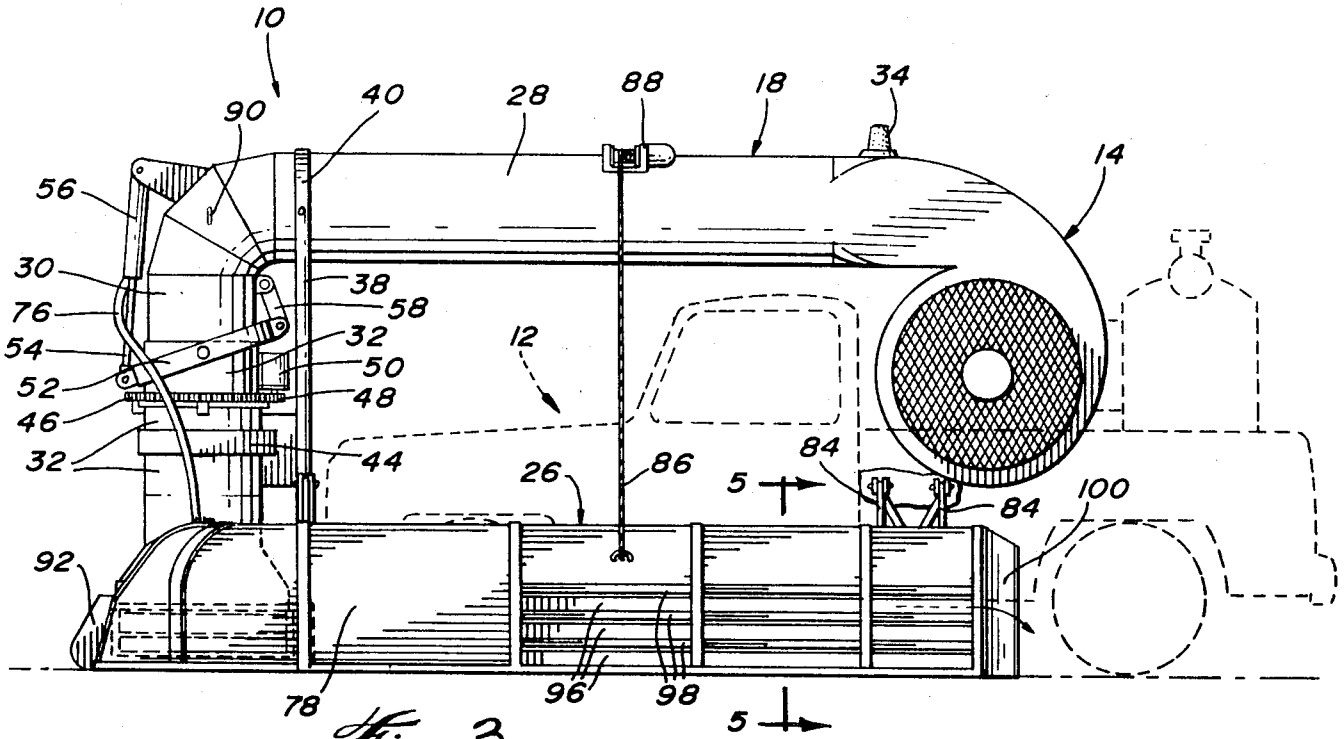
FIG. 3 is a side elevation view of the same apparatus.
Figure 4:
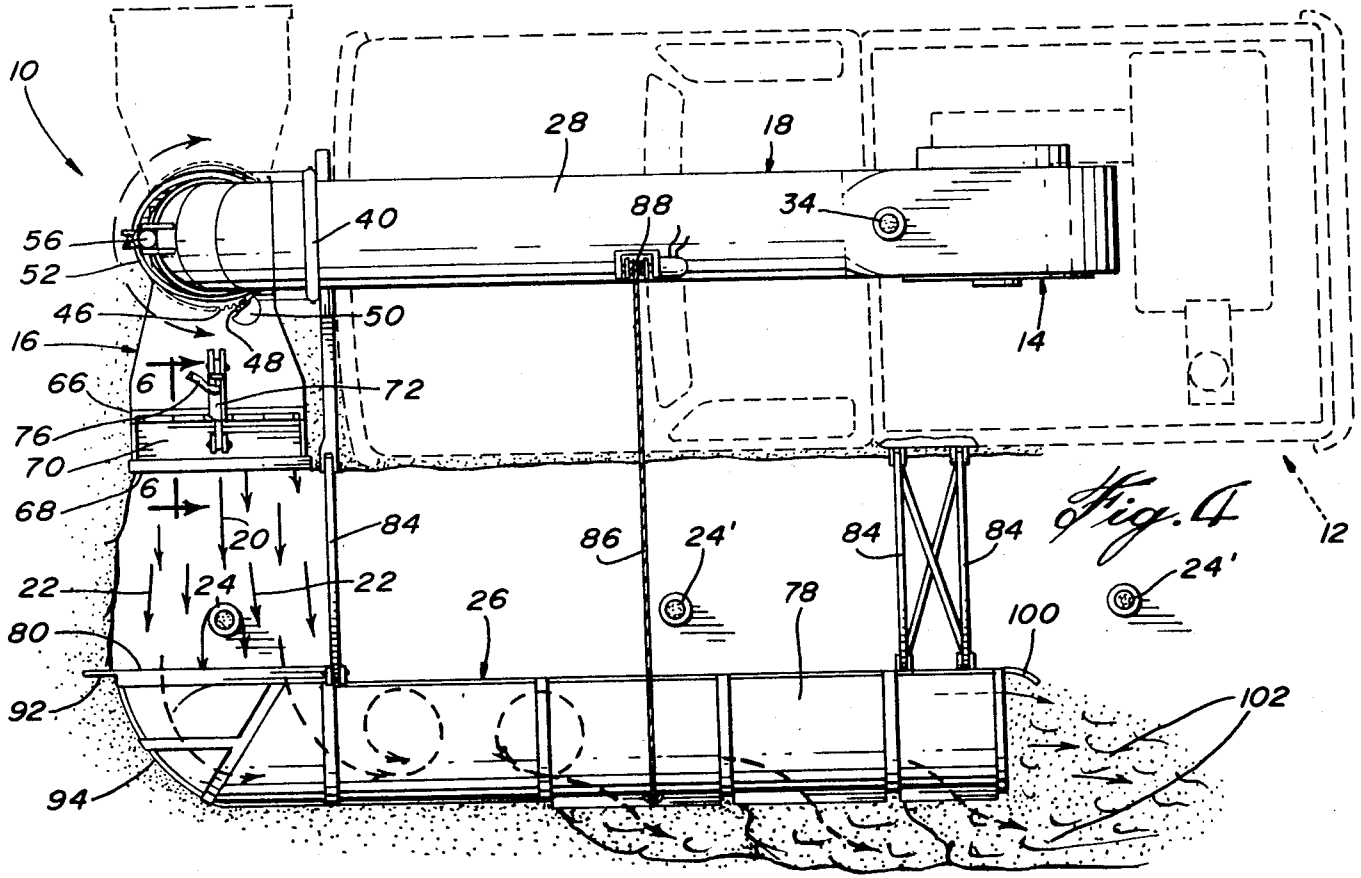
FIG. 4 is a top view of the apparatus shown in operation.

The rotation of the duct portion 32 is effected by means of the gear ring 46 which is fixed to the duct portion 32 and meshes with the driving gear 48 connected to the rotor of motor 50, as best shown in FIGS. 3 and 4. The motor 50 is operated from the cab of the truck 12. Thus, by rotating the duct portion 32 about its vertical axis, the nozzle 16 can be swung about the same vertical axis along an arcuate path so as to be operatively oriented transversely to the direction of travel of the truck 12, in either lateral direction extending away from the truck, as shown in FIGS. 2 and 4.

In order to move the lower outer duct portion 32 vertically over the upper inner duct portion 30 and thus to adjust the height of the nozzle 16 relative to the ground, a lifter ring 52 is provided which carries the duct portion 32 and is pivotally connected at the front to the piston 54 of the hydraulic cylinder 56 and, at the rear, to the link member 58, as best shown in FIG. 3. The hydraulic cylinder 56 is supplied with hydraulic fluid via the pressure line 60 and is operated from the cab of the truck 12. Retraction of the piston 54 inside the cyclinder 56 causes the ring 52 to lift the lower duct portion 32 and to thereby move the nozzle 16 upwardly to the upper position shown in broken line in FIG. 2.

As shown in FIGS. 1 and 2, the housing of the nozzle 16 has upper and lower converging walls 62 and 64. The nozzle head 66 and opening 68 are shaped to provide a shallow sweeping air stream exiting therefrom. In the embodiment illustrated, the nozzle head 66 has a rectangular cross-section with a longitudinal axis extending parallel to the ground and the opening 68 is similarly rectangular, as best shown in FIG. 4.

Figure 6:
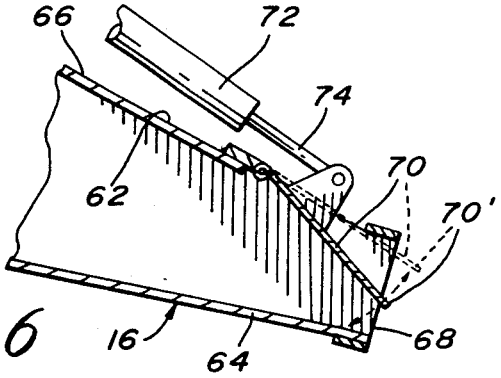
FIG. 6 is another cross-section taken along line 6—6 of FIG. 4.

A rectangular flap 70 is disposed in the nozzle head 66 transversely to the direction of flow and is hinged to the upper wall 62 for pivotal movement between open and partially closed positions, as best shown in FIG. 6. The flap 70 is moved by means of the hydraulic cylinder 72 having the piston 74 thereof pivotally connected to the flap. The hydraulic cylinder 72 is supplied with hydraulic fluid via the pressure line 76 shown in FIGS. 1 and 2 and is operated from the cab of the truck 12. By moving the flap 70 from the open position shown in broken line in FIG. 6 to the partially closed position shown in solid line, the depth of the opening 68 is reduced such that the velocity of the air stream exiting therefrom is increased and the shallowness reduced. Thus, with the flap 70, one can adjust the velocity as well as the shallowness of the air stream discharged from the nozzle 16.

It is to be noted that the flap 70 has a free longitudinal edge portion 70' projecting outwardly of the nozzle head 66. The provision of such a projecting free edge portion 70' prevents the air stream once having impinged on the flap 70 in the partially closed position from being upwardly deflected by the outermost edge portion of the lower wall 64 and thus enables the discharged air to be maintained in a confined downwardly directed stream. It will also be seen that the flap 70 serves the purpose of correcting the trajectory followed by an air stream discharged from the nozzle head at an improper height, that is, at a too high level that would cause the directed air stream 20 to impinge on the ground too close to the light 24 and thus risk damaging same, by directing the air stream so as to be deflected on the ground further away from the light 24, the loss in velocity of the deflected air stream 22 as a result of the greater distance from the light being compensated for by the increase in velocity of the directed air stream 20 exiting from the opening 68 at a reduced depth.

As an example of typical dimensions for the rectangular opening 68, the latter may have a length of about 30 inches and a depth which is variable from about 3 inches when the flap 70 is in the partially closed position to about 8 inches when it is in the open position.

Figure 7:
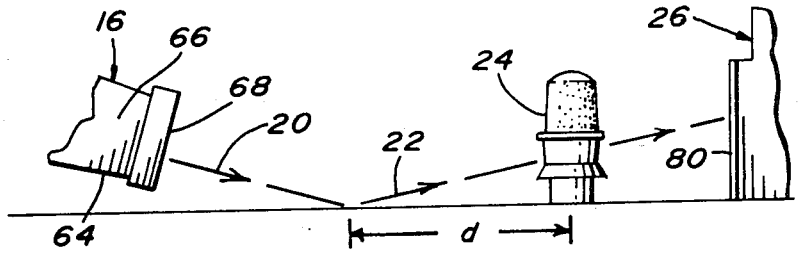
FIG. 7 is a schematic representation illustrating the flow path followed by the air stream exiting from the nozzle of the apparatus.

Turning to FIG. 7 which schematically illustrates the flow path followed by the air stream discharged from the nozzle 16, the nozzle head 66 is positioned adjacent the ground at an angle to deflect the directed air stream 20 on the ground at a distance d from the taxi-light 24. The angle of deflection and distance d are such that the deflected air stream impinges on the light 24 at a reduced velocity sufficient to remove snow therefrom without damaging same and spreads over a surrounding area with sufficient pressure to clear the area of snow. The snow guide 26 is positioned with its mouth opening 80 to receive the snow blown away from the light 24 and the surrounding area.

If the angle of deflection is too steep, the downwardly directed air stream 20 impinges on the ground too directly and thus causes the snow to swirl in front of the taxi-light 24; on the other hand, a too shallow angle of deflection would cause the deflected air stream 22 to impinge upon the light 24 too directly and at a too high velocity, thereby risking of breaking same. In addition, if the directed air stream 20 is deflected on the ground too close to the taxi-light 24, the deflected air stream 22 has a too high velocity and may thus break the light; it also does not clear a sufficiently wide area of snow around the light. If, on the other hand, the air stream 20 is deflected on the ground too far away from the light, the deflected air stream 22 loses too much velocity and spreads over the ground to a too great extent, thereby losing its pressure.

It has been found that by orienting the nozzle 16 such that the lower wall 16 thereof is angularly inclined at an angle of about 10° relative to the ground and by positioning the nozzle head at a height of about 3 inches above the ground and at a distance of about 3 feet from the taxi-light 24, with the flap 70 in the open position, the directed air stream 20 at a velocity of about 200 m.p.h. is ideally deflected on the ground at a distance d of about 18 inches from the light and the deflected air stram 22 impinges on the light with a reduced velocity sufficient to effectively remove the snow therefrom without damaging same. The deflected air stream 22 also has sufficient pressure to clear about 18 inches of snow in front of as well as beyond the light 24.

Figure 5:
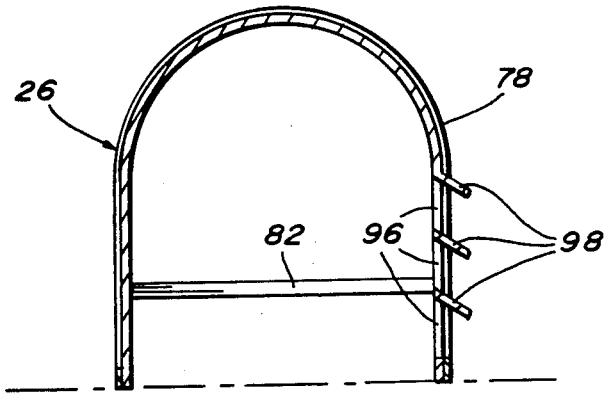
FIG. 5 is a cross-section taken along line 5—5 of FIG. 3.

The snow guide 26 which serves to channel the snow blown away from the taxi-light 24 and the surrounding area to the rear remotely of the light comprises an elongated open-ended duct 78 extending rearwardly of the nozzle 16 and laterally spaced from the nozzle with the light 24 therebetween, one end of the duct 78 being adjacent the light and defining a mouth opening 80 for receiving the blown snow. The duct 78 has a hemispherical cross-section and is thus downwardly opened along its entire length, the sidewalls thereof being interconnected together by means of braces 82, as best shown in FIG. 5. It is adapted to dampen the air entraining the blown snow so as to cause the snow to pile up remotely of the taxi-light 24.

The snow guide 26 is pivotally connected to one side of the truck 12 by means of the arms 84, for pivotal movement between the retracted position shown in broken line in FIG. 2, whereat it is above the ground and closely adjacent the truck, and the extended operative position shown in solid line, whereat it is remote from the truck and adjacent the ground. The snow guide is pivotally moved by means of the cable 86 connected to the winch 88. A stop member 90 projects laterally of the air duct 18 so as to enable the snow guide 26 to abut thereagainst when in the retracted position.

The duct 78 is equipped at the foremost edge thereof with a snow breaking blade 92. The lower leading edge of the blade 92 is rounded-off so as to permit the snow guide 26 to contour ground imperfections such as bumps as the snow guide is moved forwardly with the truck 12. The front end surface of the duct 78 is also curved at an angle of about 45° relative to the longitudinal axis of the duct so as to act as a snow-plough and thus guide the snow to the side during the forward movement of the snow guide 26, as best shown in FIG. 4.

The duct 78 has at the rear a plurality of longitudinally extending ports 96 which direct the air with entrained snow in a direction away from the taxi-light 24. Each port 96 is provided with a longitudinally downwardly extending louver-like deflector 98 for directing the snow towards the ground. Finally, a rear end deflector 100 projects laterally outwardly of the rear end of the duct 78 so as to assist in directing the snow laterally away from the light 24.

Summarizing the operation of the snow removal apparatus 10, after the runway has been cleared of snow, the truck 12 positioned sidewise adjacent one series of taxi-lights 24 on one side of the runway such that the nozzle head 66 in the operative lateral position directly in front of one taxi-light is at an appropriate distance relative to the light, for example 18 inches. The nozzle head is then adjusted to an appropriate height above the ground, for example 3 inches. Thereafter, the air blower 14 is activated and the truck 12 is driven to follow along the runway a path parallel to the series of lights 24 and to thereby remove with the deflected air stream 22 the snow from the lights one after the other and also clear an area of snow in front of and beyond each light as the truck 12 advances along the runway, leaving behind cleaned lights 24' with no snow therebetween, as best shown in FIG. 4. If the nozzle head 66 is inadvertently positioned too high above the ground, the trajectory of the discharged air stream can be immediately corrected by means of the flap 70 as described previously, or the nozzle head can be simply lowered. In order to prevent the blown snow from swirling above the cleaned lights and falling back thereonto in the case of gusting winds blowing in a direction opposite the direction of the discharged air stream, the snow guide 26 can be lowered from its upper retracted position to the operative extended position shown in FIG. 4, such that the discharged air with the entrained snow are channelled through the duct 78 and thus dampened to form a pile of snow 102 remotely of the cleaned lights. Once the series of taxi-lights on one side of the runway have all been cleaned, the same procedure is repeated for the other series of taxi-lights located on the other side of the runway.

As it is apparent, the present invention provides a convenient, effective and rapid way of removing snow from a light fixture such as a taxi-light without damaging same, and simultaneously clearing a surrounding area of snow. The snow removal apparatus of the invention not only eliminates the risk of damage to such lights but also significantly reduces the labour costs involved, and thus it contributes to lower the costs of operation of an airport.

I claim:

1. A snow removal apparatus mounted on a vehicle, for removing snow from a light fixture protruding from the ground, said snow removal apparatus comprising:

(a) means for providing a flowing stream of air;

(b) nozzle means connected to said air stream providing means for directing said air stream at the ground, said air stream providing means and said nozzle means adapted to produce a directed stream of air having a flow velocity of at least about 180 mph;

(c) said nozzle means adapted to be operatively positioned adjacent the ground at an angle to deflect said directed air stream on the ground at a predetermined distance between a light fixture and said nozzle so as to cause the deflected air stream to impinge on a light fixture at a reduced velocity sufficient to remove snow therefrom without damaging same, and to spread over a surrounding area with sufficient pressure to clear said area of snow;

(d) guide means mounted on said vehicle and laterally spaced from said nozzle means a distance sufficient to permit a light fixture to be positioned therebetween for guiding the blown snow away from a light fixture and the surrounding area and preventing the blown snow from swirling above a light fixture and falling back thereupon.

2. An apparatus as claimed in claim 1, including means for adjustably increasing the flow velocity of said directed air stream.

3. An apparatus as claimed in claim 2, wherein said nozzle means comprises a housing having upper and lower converging walls and a head with an opening which are shaped to provide a shallow sweeping air stream exiting therefrom, and wherein said adjustable air velocity increasing means comprises a similarly shaped flap member disposed in said head transversely to the direction of flow and hinged to said upper wall for pivotal movement between open and partially closed positions, and actuating means for pivotally moving said flap member between said positions so as to adjustably vary said opening and thereby provide a directed air stream having a desired velocity and shallowness.

4. An apparatus as claimed in claim 3, wherein said nozzle head has in cross-section a length greater than depth with a longitudinal axis extending parallel to the ground, and wherein said flap member has a free longitudinal edge portion projecting outwardly of said head.

5. An apparatus as claimed in claim 4, wherein said nozzle head is substantially rectangular in cross-section and said opening has a substantially rectangular shape.

6. An apparatus as claimed in claim 1, wherein said nozzle means comprises a housing having upper and lower converging walls and a head with an opening which are shaped to provide a shallow sweeping air stream exiting therefrom.

7. An apparatus as claimed in claim 1, wherein said nozzle head is spaced at about 3 inches from the ground and at about 3 feet from a light fixture whereby to deflect said directed air stream on the ground at a distance of about 18 inches from said light fixture.

8. An apparatus as claimed in claim 1, wherein said nozzle means is movable vertically so as to be adjusted in height relative to the ground.

9. An apparatus as claimed in claim 1, wherein said nozzle means is swingable about a vertical axis along an arcuate path so as to be operatively oriented transversely to the direction of travel of said vehicle in either lateral direction extending away from said vehicle.

10. An apparatus as claimed in claim 9, wherein said nozzle means is mounted forwardly of said vehicle.

11. An apparatus as claimed in claim 10, wherein said air stream providing means comprises an air blower mounted on said vehicle rearwardly of said nozzle means and a duct connecting said air blower to said nozzle means.

12. An apparatus as claimed in claim 11, wherein said duct comprises a horizontal duct section connected to said air blower and extending over said vehicle, and a vertical duct section interconnecting said horizontal duct section with said nozzle means, said vertical duct section having telescoping upper and lower duct portions.

13. An apparatus as claimed in claim 12, wherein said lower duct portion is mounted for vertical movement so as to enable said nozzle means to be adjusted in height relative to the ground, as well as for rotation about its vertical axis so as to permit said nozzle means to swing along said arcuate path, separate actuating means being provided to vertically move said lower duct portion and to rotate same.

14. An apparatus as claimed in claim 1, wherein said snow guide means comprises an elongated open-ended duct extending rearwardly of said nozzle means and being downwardly opened along its entire length, one end of said duct being adjacent a light fixture and defining a mouth opening for receiving said blown snow, said duct adapted to dampen the air entraining said blown snow so as to cause said snow to pile up remotely of a light fixture.

15. An apparatus as claimed in claim 14, wherein said duct is provided at a rear portion thereof with a plurality of longitudinally extending ports disposed to direct said air with entrained snow in a directing away from a light fixture.

16. An apparatus as claimed in claim 15, wherein each said port is provided with a respective longitudinally downwardly extending louver-like deflector for directing said air with entrained snow towards the ground.

17. An apparatus as claimed in claim 14, wherein said duct is mounted on one side of said vehicle for vertical pivotal movement between a retracted position whereat said duct is above ground and closely adjacent said vehicle and an extended operative position whereat said duct is remote from said vehicle and adjacent the ground.

18. An apparatus as claimed in claim 14, wherein said duct has a hemispherical cross-section.

19. A method of removing snow from a light fixture or the like protruding from the ground comprising:

(a) providing a flowing stream of air;

(b) directing said air stream through a nozzle means at a flow velocity of at least 180 mph onto the ground at an angle of about 10° to the horizontal and at a predetermined distance between the light fixture and the nozzle; and (c) causing the deflected air stream to impinge on the light fixture at a reduced velocity sufficient to remove snow therefrom without damaging same and to spread the snow over a surrounding area with sufficient pressure to clear the area around the light fixture of snow.

20. The method of claim 19 wherein said velocity is between 180 and about 250 m.p.h.

21. The method of claim 19 wherein said velocity is about 200 m.p.h.

22. The method of claim 19 wherein said distance is about 18 inches.

23. The method of claim 19, wherein said angle is about 10°.

24. A method of removing snow from a light fixture or the like protruding from the ground comprising:

(a) providing a flowing stream of air;

(b) directing said air stream through a nozzle means at a flow velocity of between about 180 and 250 mph onto the ground at an angle of about 10° to the horizontal and at a distance of about 18 inches from the light fixture and between the nozzle and the light fixture; and (c) causing the deflected air stream to impinge on the light fixture at a reduced velocity sufficient to remove snow therefrom without damaging same and to spread the snow over the surrounding area with sufficient pressure to clear the area around the light fixture of snow.

25. The method of claim 24 including adjustably increasing the flow velocity of the air stream.

26. The method of claim 24 including spacing said nozzle about 3 inches from the ground and at about 3 feet from the light fixture.

27. The method of claim 24 including vertically moving said nozzle so as to adjust the height thereof relative to the ground.

28. The method of claim 24 including mounting said nozzle on a vehicle and swinging said nozzle about a vertical axis along an arcuate path so as to be operatively oriented transversely to the direction of travel of the vehicle in both lateral directions extending away from the vehicle.

29. The method of claim 24 including guiding the snow blown away from the light fixture and the surrounding area to prevent the blown snow from swirling above the light fixture and falling back thereupon.

30. The method of claim 29 including dampening the air entraining the blown snow so as to cause the snow to pile up remote from the light fixture.

* * * * *